US005570121A

United States Patent [19]

Mistyurik et al.

[11] Patent Number: 5,570,121

[45] Date of Patent: Oct. 29, 1996

[54] PRINTER

[75] Inventors: John D. Mistyurik, Troy; Mark W. Roth, Miamisburg; James R. Small, Beavercreek. all of Ohio

[73] Assignee: Monarch Marking Systems, Inc., Dayton, Ohio

[21] Appl. No.: 169,899

[22] Filed: Dec. 20, 1993

[51] Int. Cl.[6] ..... B41J 2/32

[52] U.S. Cl. ..... 347/171; 347/222

[58] Field of Search ..... 346/76 PH; 400/120, 400/120.01; 156/384, 277, 387, 541; 347/171, 222, 197

[56] References Cited

U.S. PATENT DOCUMENTS

| | | | |
|---|---|---|---|
| 4,666,319 | 5/1987 | Hirosaki et al. | 156/384 |
| 4,776,714 | 10/1988 | Sugiura et al. | 400/248 |
| 4,956,045 | 9/1990 | Goodwin et al. | 156/384 |
| 4,957,379 | 9/1990 | Hamisch, Jr. et al. | 400/120 |
| 5,206,662 | 4/1993 | Fox et al. | 346/76 PH |
| 5,336,003 | 8/1994 | Nagashima et al. | 156/384 |
| 5,401,352 | 3/1995 | Matsushita et al. | 156/384 |

FOREIGN PATENT DOCUMENTS 0449236 10/1991 European Pat. Off. .

*Primary Examiner*—Huan H. Tran
*Attorney, Agent, or Firm*—Joseph J. Grass

[57] ABSTRACT

There is disclosed a thermal printer having a print head and a pressure roller cooperable with a platen roll, with one manually operable member for substantially simultaneously separating the print head and the pressure roll for threading the printer and another member for separating the print head widely from the platen roll for cleaning purposes.

9 Claims, 4 Drawing Sheets

PRINTER

BACKGROUND OF THE INVENTION

1. Field of the Invention

This invention relates to the printing art.

2. Brief Description of the Prior Art

The following patents are made of record: U.S. Pat. Nos. 4,776,714; 4,956,045; 4,957,379 and European patent application 0 449 236.

SUMMARY OF THE INVENTION

The invention relates to an improved, low cost, simple, easy-to-use printer.

It is a feature of the invention to provide an improved printer in which labels releasably adhered to a carrier web can be printed by a thermal print head cooperable with a platen roll at a printing position, and in which a pressure roller contacts the carrier web downstream of the printing position and urges the carrier web against the platen roll, and a slide which enables the user to separate both the print head and the pressure roller from cooperation with the platen roll. In a preferred embodiment, the pressure roller is mounted on a slide, and the print head is a part of a print head assembly. The print head assembly and the slide are urged relatively toward each other and into cooperation with the platen roll by preferably two springs.

It is another feature of the invention to provide an improved construction for a printer, wherein a platen roll is mounted on a drive shaft, the drive shaft is rotatably mounted in mounting members secured to the frame, an electric motor drives the drive shaft through gearing, and a delaminator is held captive between the mounting members and the frame.

It is another feature of the invention to provide two separate means for separating the print head and the platen roll. One of these means includes a manually operable lever for moving the print head away from the platen roll by a certain distance to facilitate threading of the printer. The other means moves the print head away from the platen by a greater distance to enable the print head to be readily cleaned.

Other features and advantages will become apparent to those skilled in the art from the following detailed description and by reference to the accompanying drawings.

DETAILED DESCRIPTION OF THE PREFERRED EMBODIMENT

Figure 1:
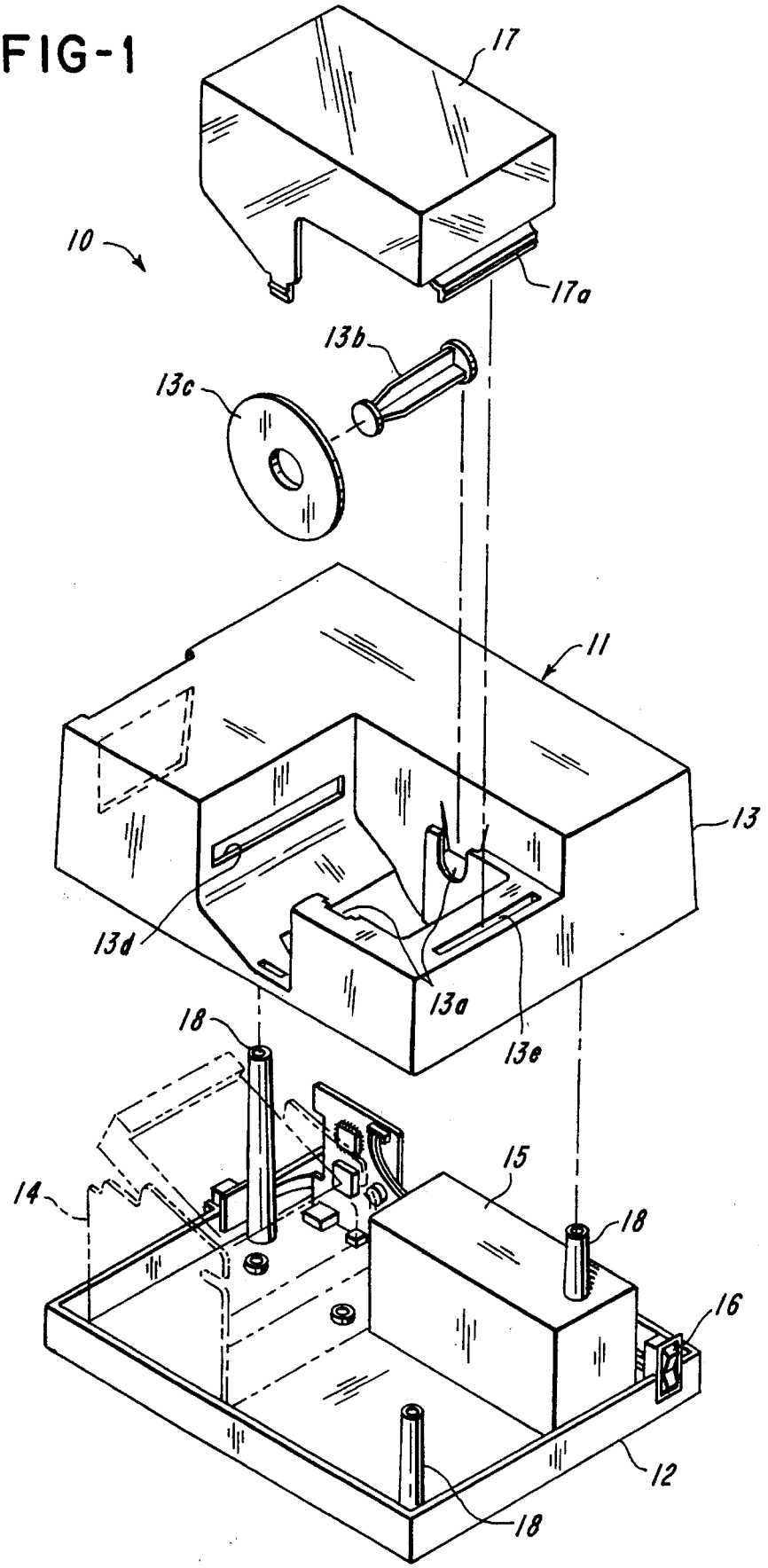
FIG. 1 is a partially exploded perspective view of the printer of the invention, with certain parts shown by phantom lines.

With reference to FIG. 1, there is shown a printer generally indicated at 10 having a housing 11 comprising a base 12 and a cover 13. The base 12 mounts a printer mechanism 14 shown in phantom lines. The base 12 includes a box-like portion 15 for housing a battery pack (not shown). An on/off switch 16 is located at the rear of the base 12. The cover 13 has a pair of opposed slots 13*a* for receiving end portions of a spindle 13*b*. A roll (not shown) of record members RM (FIG. 3) is received on the spindle 13*b*. A disc 13*c* serves as a guide for one side of the roll. The cover 13 has a slot 13*d* through which the record members RM can pass to the printer mechanism 14. A dust cover 17 having a projection 17*a* received in a slot 13*e* is pivotally mounted on the cover 13 for movement between closed and open positions. Posts 18 are used to secure the cover 13 to the base 12.

Figure 2:
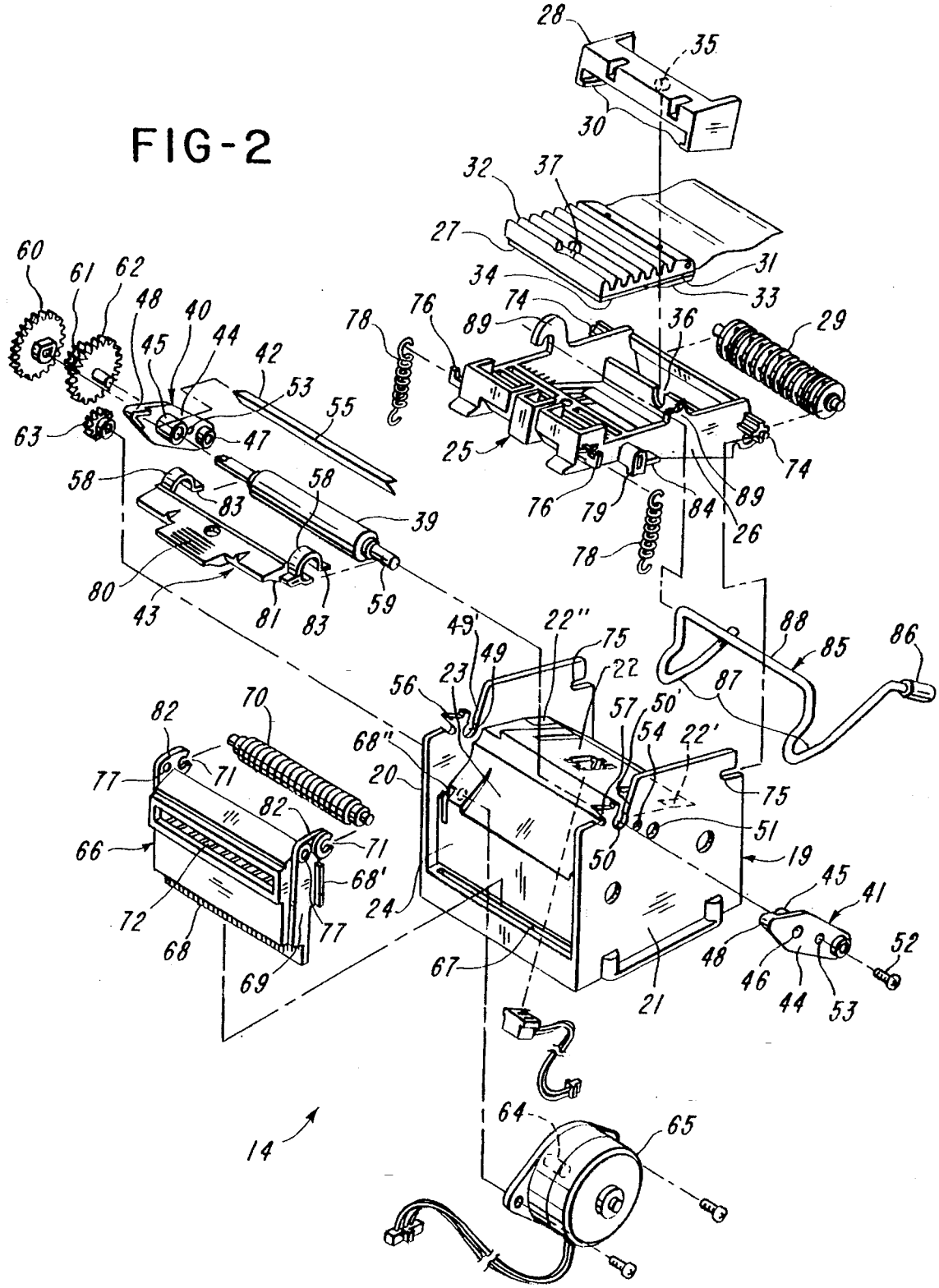
FIG. 2 is an exploded perspective view showing various components of the printer.

With reference to FIG. 2, the printer mechanism 14 is shown to include a frame 19 having end walls 20 and 21, an upper guide surface 22 joined to a front guide surface 23, and a front wall 24.

A print head assembly generally indicated at 25 includes a holder 26, a print head device 27 and its mounting member 28, and a guide roller 29. The mounting member 28 has a pair of opposed parallel ridges 30 received beneath the underside of a heat sink 32. A print head 34 is disposed on the underside of the heat sink 32. The mounting member 28 has an annular stud 35 received in a notch 36 in the holder 26. The heat sink 32 has a recess 37 for receiving a rounded projection 38 (FIG. 4) on the holder 26. There is clearance between the print head device 27 and the holder 26 so that the print head device 27 can rock or pivot slightly relative to the firmly mounted holder 26. This allows the print head 34 to accommodate to a platen roll 39. It is apparent that the projection 38 received in the recess 37 and the stud 35 received in the notch 36 enable the print head device 27 to rock or pivot.

A pair of identical mounting members 40 and 41 mount the platen roll 39, a delaminator 42 and a lever 43. Each mounting member 40 and 41 has a plate or wall 44, a tubular projection 45 aligned with a cutout 46 in the wall 44, a tubular projection 47, and an angle-shaped wall or projection 48. The projections 45 are received in respective cutouts 49 and 50 in end walls 20 and 21. The projections 47 are received in holes 51 (only one of which is shown) in end walls 20 and 21. Screws 52 (only one of which is shown) pass through respective holes 53 in plates 44 and are threadably received in holes 54 (only one of which is shown) in end walls 20 and 21.

Figure 3:
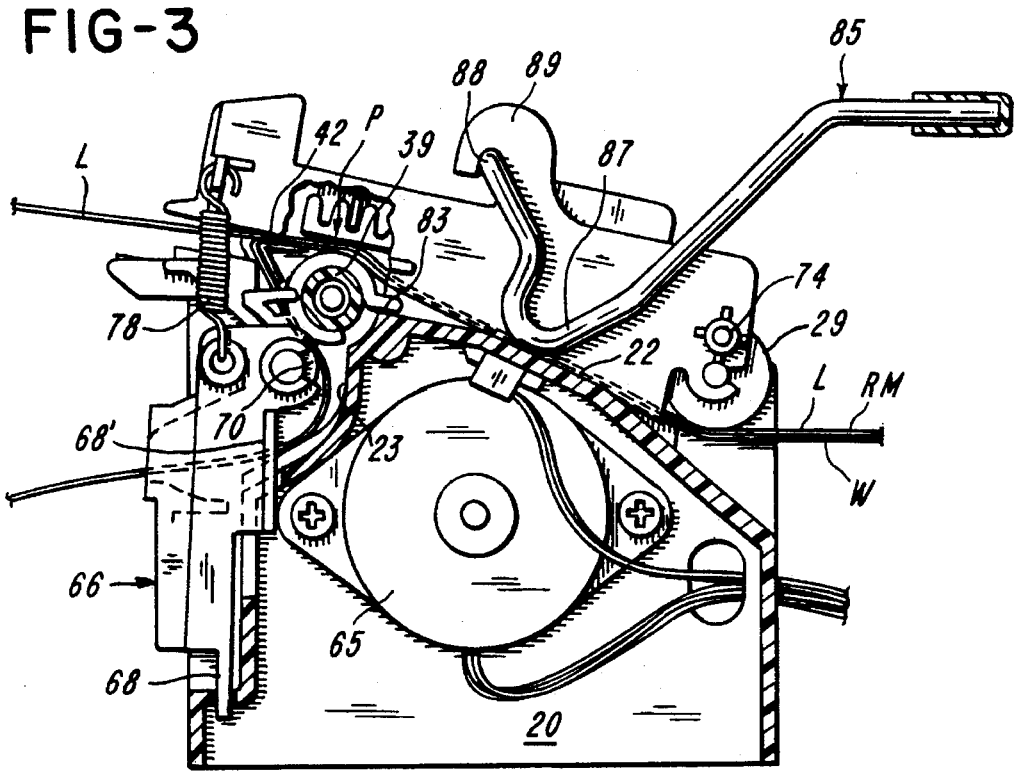
FIG. 3 is a sectional view showing the relationship of operative parts with the print head assembly, the slide and the pressure roller being shown in the operating position.
Figure 4:
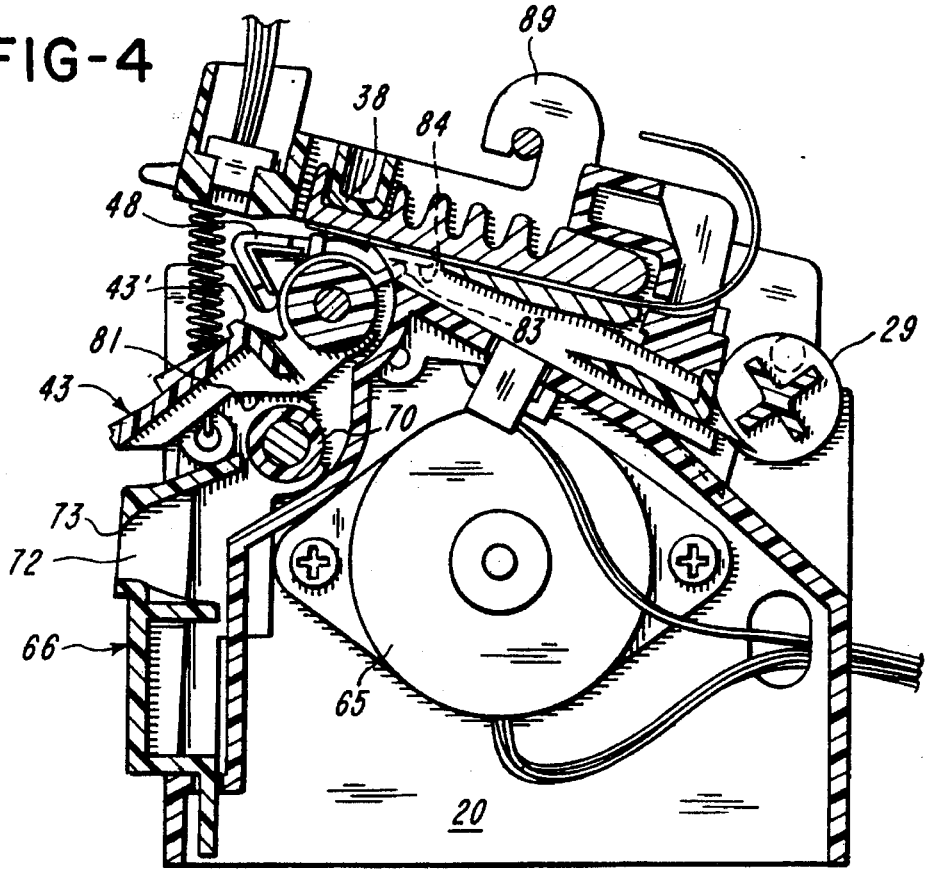
FIG. 4 is a sectional view similar to FIG. 3 but showing the print head assembly in a raised position wherein the print head is separated from the platen roll and wherein the pressure roller is separated from the platen roll.
Figure 5:
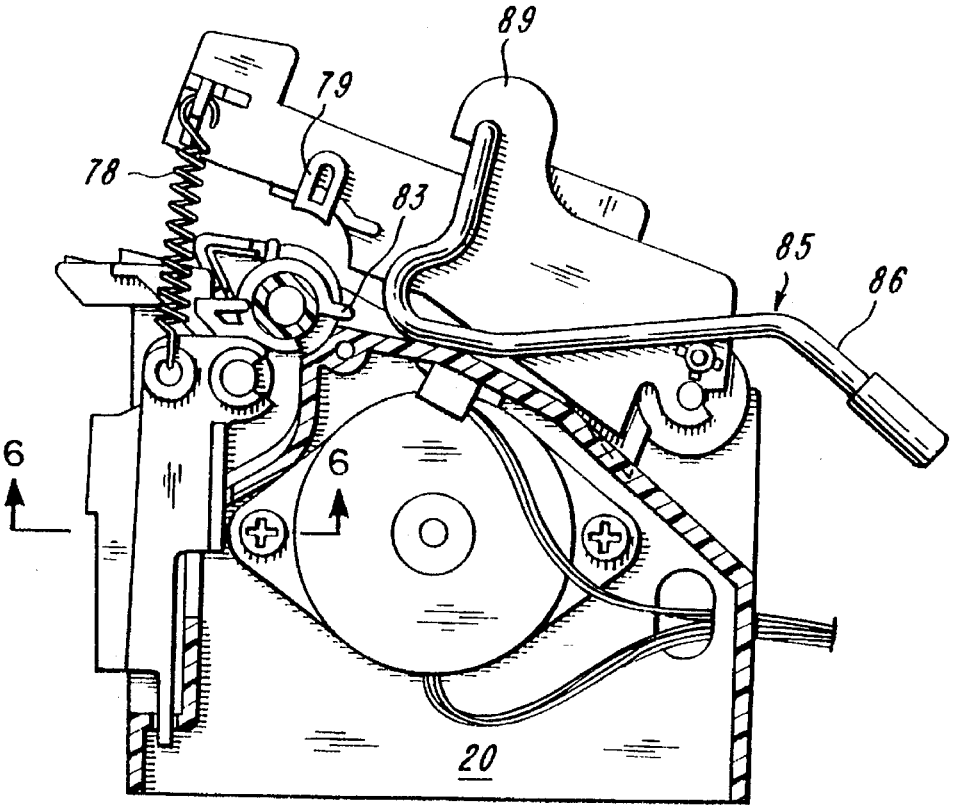
FIG. 5 is a fragmentary partly sectional view in which another device is used to separate the print head assembly widely from the platen roll to facilitate cleaning of the print head and/or the platen roll.

The delaminator 42 is comprised of a bar which has an acute-angled profile as shown in the drawings. The delaminator 42, thus, provides a peel edge 55 by which a label L (FIG. 3) can be delaminated from the carrier web W. The delaminator 42 fits over acute-angled projections 56 and 57 on end walls 20 and 21. The delaminator 42 is held in place by the angle-shaped wall 48. The captive relationship of the delaminator 42 to the projection 56 and the angle-shaped wall 48 is shown for example in FIG. 4. The lever 43 has generally C-shaped aligned portions 58 received on projections 45. The platen roll 39 is secured to a drive shaft 59 which extends into the projection 45 of the mounting member 41 and extends through the projection 45 in the mounting member 40. A gear 60 is secured to the shaft 59. The gear 62 meshes with a gear 63 secured to an output shaft 64 of an electric stepping motor 65. As shown in FIGS. 3, 4 and 5, the motor 65 is secured to the end wall 20.

Figure 6:
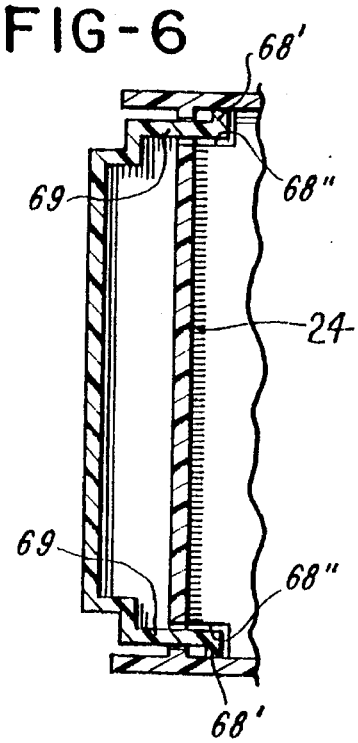
FIG. 6 is a sectional view taken along line 6—6 of FIG. 5 showing the slide retained in the frame.

A slide 66 is mounted for movement at the front wall 24. The front wall terminates at a slot 67 which receives a projection 68 which forms part of the slide 66. The slide 66 has outwardly extending flanges 68' (FIGS. 2 and 6) on walls 69. Flanges 68' are received in slots 68" in the front wall 24. The slide 66 is thus mounted for sliding generally vertical movement at the front wall 24. The slide 66 mounts a pressure roller 70 in C-shaped recesses 71. The slide 66 has an opening 72, the upper edge 73 of which provides a slightly serrated tear edge.

The print head assembly 25 is pivotally mounted to the frame 19 by projections 74 received in slots 75. The holder 26 has hook-shaped ears 76 and the slide 66 has holes 77. Tension springs 78 are connected at their one ends to the ears 76 and at their other ends in holes 77. Thus, the springs 78 simultaneously urge the print head assembly 25 counterclockwise and to urge the slide 66 upwardly as shown for example in FIG. 3. The holder 26 has two downwardly facing projections 79 which are received in converging slots 49' and 50' in end plates 20 and 21. The sides of the cooperating slots 49' and 50' contact the sides of the projections 79 to provide consistent accurate location of the print head assembly 25 with respect to the platen roll 39.

As shown in FIG. 3, the web of record members RM comprises a carrier web W to which a series of labels L are releasably secured. The carrier web W passes over the surface 22 and the labels are printed at a printing position P by the print head 34 cooperating with the driven platen roll 39. The carrier web W passes around the platen roll 39 for a considerable distance and the pressure roll 70 presses the carrier web W against the platen roll 39 as shown. The carrier web W continues to advance while the platen roll 39 is driven and the carrier web W is guided by the wall or surface 23 and exits the opening 72 in the slide 66. The springs 78 urge the slide 66 upwardly and in turn urge the pressure roller 70 into cooperation with the platen roll 39, and, or course, the carrier web W is between and in contact with the pressure roller 70 and the platen roll 39. The lever 43 has a ribbed guide surface 43' which allows only enough clearance for the carrier web W to pass. Therefore, the carrier web W passes between one leg of the delaminator 42 and the guide surface 43'. The delaminator 42 is preferably composed of smooth metal. The cooperation between the guide surface 43, and the delaminator 42 prevents the carrier web W from becoming excessively slack and it also ensures a small peel radius should a slack condition occur.

When it is desired to thread the printer 10 with the web of record members RM, the user depresses the lever 43 with one finger at its finger-engageable portion 80. This causes the springs 78 to be extended as best shown in FIG. 4. The lever has a pair of spaced cam surfaces 81 which bear against surfaces 82 in the slide 66. Therefore, when the lever 43 is depressed against the urging of the springs 78, the slide 66 is cammed downwardly. Accordingly, the pressure roller 70 is moved out of cooperation with the platen roll 39. Substantially simultaneously, projections 83 on C-shaped portions 58 act on pads 84 on the holder 26 to pivot the print head assembly 25 clockwise against the action of springs 78. In this position of the lever 43, the web of record members RM can be threaded through the printer 10 along the label and carrier web pathways shown in FIG. 3 for example. After threading, the lever 43 can be released and the springs 78 pivot the print head assembly counterclockwise and move the slide 66 upwardly.

A device 85 is used to move the print head assembly 25 to a position in which the print head 34 and the platen roll 39 can be readily cleaned, as shown in FIG. 5. The device raises the print head assembly 25, by pivoting it clockwise, without moving the slide 66. Thus, the springs 78 are not stretched excessively. The device 85 (FIGS. 2, 3 and 5) comprise a wire which has been bent to provide an operating handle 86, bearing portions 87 and a connector portion 88. Normally the device 85 is in the position shown in FIG. 3 with its bearing portions 87 in contact with surfaces 22' outboard the path of the record members RM. The connecting portion passes through two-spaced hook-shaped portions 89 on the holder 26. As the device 85 is pivoted from the position shown in FIG. 3 to the position shown in FIG. 5, the bearing portions 87 slide on surfaces 22' to the position shown in FIG. 5, in which position the device 85 is overcenter and thus is held in the FIG. 5 position. After the print head 34 and the platen roll 39 have been cleaned the device can be returned to the FIG. 3 position by lifting the handle 86.

Other embodiments and modifications of the invention will suggest themselves to those skilled in the art, and all such of these as come within the spirit of this invention are included within its scope as best defined by the appended claims.

We claim:

1. A printer, comprising: a frame, means for holding a composite web comprised of pressure sensitive labels releasably adhered to a carrier web, a thermal print head mounted on the frame, a platen roll cooperable with the print head at a printing position to print on the labels, a slide movably mounted on the frame, a pressure roller rotatably mounted on the slide, the pressure roller being cooperable with the carrier web downstream of the printing position, and means for biasing the slide to urge the pressure roller into cooperation with the carrier web and the platen roll.

2. A printer as defined in claim 1, further comprising a print head assembly including the print head, wherein the biasing means includes a tension spring connecting the print head assembly and the slide, whereby the print head is urged into printing cooperation with the platen roll.

3. A printer as defined in claim 1, further comprising a print head assembly including the print head, and means for substantially simultaneously moving the print head and the pressure roller out of cooperation with the platen roll.

4. A printer as defined in claim 3, wherein the moving means includes a manually movable lever.

5. A printer as defined in claim 3, further including means acting on the print head assembly for moving the print head out of cooperation with the platen roll without moving the pressure roller.

6. A printer, comprising: a frame, a print head and a cooperable platen roll, a pair of mounting members secured to the frame, a drive shaft rotatably mounted in the mounting members, a delaminator held captive by and between the mounting members and the frame, an electric motor, and gearing connecting the motor and the platen roll.

7. A printer as defined in claim 6, further including a print head assembly having the print head, first means for moving the print head assembly to separate the print head and the platen roll by up to a certain distance, and second means for moving the print head assembly to separate the print head and the platen roll by a distance greater than the certain distance.

8. A printer, comprising: means for holding a roll of a composite web comprised of labels releasably adhered to a carrier web, a print head, a platen roll cooperable with the print head to print on the labels at a printing position, a pressure roll being in contact with the carrier web and cooperable with the platen roll downstream of the printing position, and means for simultaneously urging the print head and the pressure roll into cooperation with the platen roll.

9. A printer as defined in claim 8, further comprising a print head assembly which includes the print head, means for mounting the pressure roll, and wherein the urging means includes a spring connecting the print head assembly and the mounting means.

* * * * *